United States Patent [19]

Dian

[11] 4,411,430

[45] Oct. 25, 1983

[54] GOLF PUTTER

[75] Inventor: Walter Dian, Downers Grove, Ill.

[73] Assignee: Walter Dian, Inc., Downers Grove, Ill.

[21] Appl. No.: 338,889

[22] Filed: Jan. 12, 1982

Related U.S. Application Data

[63] Continuation-in-part of Ser. No. 151,373, May 19, 1980, Pat. No. 4,324,404.

[51] Int. Cl.[3] ..... A63B 53/08

[52] U.S. Cl. ..... 273/171; 273/164

[58] Field of Search ..... 273/79, 168, 171, 169, 273/170, 167 F, 167 G, 167 H, 167 J, 167 K, 78, DIG. 14

[56] References Cited

U.S. PATENT DOCUMENTS

| | | | |
|---|---|---|---|
| 1,213,382 | 1/1917 | Kent | 273/171 |
| 1,643,250 | 9/1927 | Longsworth | 273/79 |
| 1,665,523 | 4/1928 | Boyce | 273/79 |
| 4,111,426 | 9/1978 | Goodwin | 273/168 X |
| 4,324,404 | 4/1982 | Dian | 273/164 X |

FOREIGN PATENT DOCUMENTS

| | | | |
|---|---|---|---|
| 252995 | 6/1926 | United Kingdom | 273/171 |

*Primary Examiner*—George J. Marlo

[57] ABSTRACT

A golf putter of the type having a head with a front to rear elongated rod-like weight or ram encased in a transparent plastics material body is provided with a rotatable rod or ram portion to shift the axial center of mass of the head to correct manufacturing variations and to correct errors in the putting stroke. The rotatable weight or ram section has an off-center or eccentric mass which is easily adjusted from the rear face of the putter head to compensate for pulled or pushed putting strokes, thereby providing a personalized "feel" facilitating impacting the ball on a "sweet spot" which will propel it on the desired putting line.

11 Claims, 14 Drawing Figures

GOLF PUTTER

RELATED APPLICATION

This application is a continuation-in-part of my allowed U.S. application, Ser. No. 151,373, filed May 19, 1980, entitled "GOLF PUTTER", now U.S. Pat. No. 4,324,404, issued Apr. 13, 1982.

BACKGROUND OF THE INVENTION

1. Field of the Invention

This invention relates to the art of golf putters of the mallet head type with elongated front to rear weight rods or rams and particularly deals with a mallet putter head with an adjustable ram shifting the longitudinal axis of mass to suit the golfer.

2. Description of the Prior Art

Mallet head putters are generally provided with large sole areas which are easily scuffed against the putting surface during the putting stroke, and have a fixed front to rear or longitudinal axis of mass which is difficult to locate when addressing the ball. Guidelines or grooves are frequently provided on the top faces of such mallet heads to assist the golfer in properly aligning the club, but, at best, these guidelines or grooves only provide for an approximate alignment of the "sweet spot" of the putter face with the ball and are useless in correcting errors in the putting stroke. These prior known mallet head putters were not adjustable, and the golfer was frequently faced with putting situations for which he did not have a comfortable "feel" for the putter, resulting in loss of confidence and frustration with frequently missed putts. It would, therefore, be an improvement in the art to provide a mallet head type putter with an adjustable axis of mass to personalize the club for individual golfers while at the same time correcting for manufacturing errors. The putters of this invention provide this improvement by incorporating a rotatable weight rod or ram portion in putters of the type disclosed in my aforesaid parent patent application, Ser. No. 151,373, filed May 19, 1980, now U.S. Pat. No. 4,324,404, issued Apr. 13, 1982.

SUMMARY OF THE INVENTION

According to this invention, a mallet head putter with a central elongated weight rod or ram extending transversely in a front to rear direction on the bottom end of a club shaft is provided with an adjustable eccentric weight portion accessible from the rear face of the mallet head to vary the longitudinal axis of mass of the club head to suit individual putting styles and to correct manufacturing errors. The putters of this invention have a head composed of clear molded plastics material forming a housing for a heavy weight rod or ram extending therethrough in a front to rear direction normal to the putting face and having a rotatable eccentric weight portion at the rear end thereof which is accessible for rotation at the back face of the head. The front end of the ram is fixed in the housing and the lower end of a putter shaft projects through the top of the head to be anchored in the ram. The ram is preferably composed of a heavy rigid metal such as brass, steel, or the like, and has a flat front face flush with the front face of the housing providing an impact zone or "sweet spot" for the putter. The shaft is preferably located in the front third of the head. The rotatable rod or ram portion fits snugly in the closed rear end of an open front cylindrical bore or chamber of the housing. The closed end of the chamber has a small aperture therethrough giving access to the rotatable rod or ram section, permitting it to be turned to vary the eccentricity of the weight thereof. This rear rotatable rod or ram section has a hollow longitudinal portion opposed by a solid longitudinal portion to provide an eccentric weight distribution with the heavy weighted portion being located in the bottom half thereof. A resilient "O" ring or washer is compressed between the closed end of the bore and the rear end of the rotatable weight or rod section holding the section tightly against the fixed front rod or ram portion, and also sealing the small opening in the closed end of the bore. The rotatable section may have a neck projecting into the aperture in the closed end of the bore receiving the ring or washer therearound, and having a tool receiving recess for a screw driver, coin, or wrench to rotate the section.

The plastics material housing is preferably transparent or at least translucent to expose the weight or ram along the length thereof to the view of the golfer when addressing the ball for the putt, enabling him to align the ram on the line of putt so that when its end face impacts the ball, it will travel on the sighted line of the putting surface. The plastics material may be an acrylic resin such as "Plexiglass-DR" supplied by Rohm and Haas Company of Philadelphia or a polycarbonate such as "Lexan" supplied by General Electric Company of Schenectady, N.Y.

In a preferred embodiment, the weight rod or ram is cylindrical having an overall length of two to three inches, and a diameter of about one-half to one inch with the rotatable section being more than one-half the length of the composite rod and preferably of the order of two-thirds of its length. The plastics material is relatively light in weight constituting only about 10 to 30% of the total weight of the head which has generally an overall weight of about 290 to 350 grams.

The putter head fully conforms with U.S.G.A. specifications, and preferably has a width of 3 to 4 inches, a depth of 2 to $3\frac{1}{2}$ inches, in a front to rear direction, and a central height of $\frac{3}{4}$ to $1\frac{1}{2}$ inches with thinner wings radiating from the sides thereof having thicknesses on the order of $\frac{3}{8}$ to $\frac{3}{4}$ of an inch with bottom faces above the bottom of the central portion so that the club head can be rocked throughout an appreciable angle without contacting the wings against the putting surface.

The central portion of the head preferably has a cylindrical dome from the front to the rear end thereof with parallel grooves on each side thereof, spaced apart about the diameter of the golf ball to serve as sighting lines for straddling the ball when addressing the putter to the ball.

With a rod or ram diameter of about one inch, the fixed ram section may have a front to rear depth of about $\frac{3}{4}$ of an inch with the rotatable ram section having a front to rear depth of about $1\frac{5}{8}$ inches, in a preferred arrangement. The projecting neck or nubbin on the rear end of the rotatable ram section may have a diameter of about $\frac{1}{4}$ of an inch.

An indicator may be provided on the rear face of the rotatable ram section aligned with the heavy or weighted portion of the section. When this weighted portion is at the very bottom of the housing, the indicator, for example, can have a six o'clock position and then when the ram section is rotated either in a clockwise or counterclockwise position, the weight distribution will be altered to compensate for either the "pulled" or "pushed" putts.

It is then an object of this invention to provide a golf club putter of the type disclosed in my allowed U.S. application, Ser. No. 151,373, filed May 19, 1980, with an adjustable weight rod or ram section to vary the longitudinal axis of mass of the putter.

Another object of this invention is to provide a ram putter with a rotatable eccentric weight ram section for varying the "feel" of the club.

A specific object of this invention is to provide a mallet head putter with a transparent plastics material head encasing a heavy weight rod which extends in a front to rear direction from the putting face and has a rotatable section at the rear end thereof with an offset weight portion to vary the longitudinal axis of mass of the putter.

A still further object of this invention is to provide a mallet head putter with a rotatable eccentric weight member which is adjustable to suit the personal putting style of a golfer.

Other and further objects of this invention will become apparent to those skilled in this art from the following detailed description of a preferred embodiment of the invention shown on the drawings, in which:

AS SHOWN ON THE DRAWINGS

Figure 1:
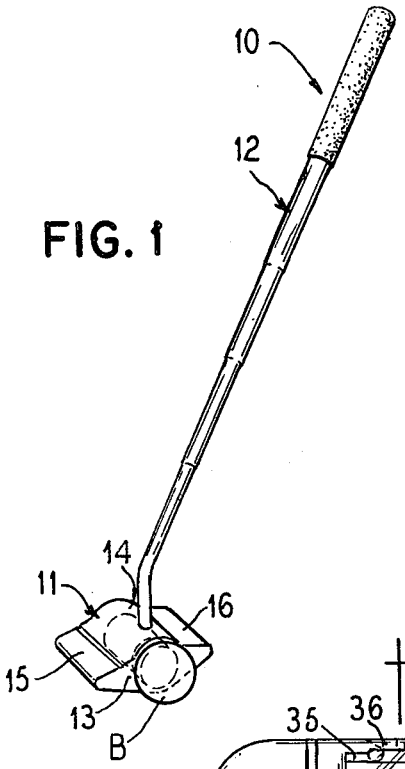
FIG. 1 is a front perspective view of a golf club putter according to this invention shown in position for impacting a golf ball.

The putter 10 of FIGS. 1–5 has a generally rectangular head 11 and an elongated shaft 12 extending upwardly from the head 11.

A front striking or impact face 13 of the head engages a conventional golf ball B at the transverse center zone thereof. The head 11, as explained above, has an appreciable front to rear depth dimension with a central thick generally cylindrical portion 14, from which project laterally extending converging wings 15 and 16. The front or toe wing 15 slopes upwardly from the bottom of the central portion 14 and downwardly from the top of the central portion to a narrow rounded front toe edge 17 while the rear or heel wing 16 converges upwardly from the bottom of the central section 14 and downwardly from the top of the central section 14 to a narrow rounded edge 18. A fragmental cylindrical dome portion 19 of the central section 14 spans the tops of the wings 15 and 16.

Longitudinally extending grooves 20 and 21 are provided in the top faces of the wings 15 and 16 and extend in a front to rear direction across the top face of the head 11. These grooves are spaced apart a distance equal to the diameter of the golf ball B to straddle the ball when the club is being addressed for a putt. The bottom or sole 22 of the putter head is thus sloped upwardly on both sides of the bottom 23 of the thickened central portion 14.

The head 11 is composed of a transparent or translucent molded plastics material housing 24 with a central front to rear extending chamber or bore 25 in the central thickened portion 14 opening at the front putting face 13 and closed at the rear end 26 which is adjacent the upright rear face 27 of the housing. A small diameter aperture 28 is provided through the closed rear end 26.

The chamber or bore 25 receives a heavy weight rod or ram 29 composed of a fixed front portion 30 and a rotatable rear portion 31. The front portion 30 has a front face 32 flush with the front face 13 of the housing 24 and a flat back face 33 inside the bore, preferably about $\frac{3}{4}$ of an inch from the front face.

The rear rotatable ram portion 31 has a front face 34 riding on the rear face 33 of the front portion 30 and a rear face 35 adjacent the closed end of the bore 26. A neck or nubbin 36 projects from the central portion of this rear face 35 into the aperture 28 and a resilient "O" ring or washer 37 surrounds this neck 36 and is squeezed between the back face 35 and the closed end 26 of the bore to urge the ram member 31 forwardly so that its face 34 remains in contact with the rear face 33 of the ram portion 30, thereby preventing end-wise shifting of the ram portion 31 without, however, interfering with rotation of this ram portion.

The fixed ram portion 30 has a blind longitudinally extending bore 38 extending from the face 33 thereof forwardly into spaced relation from the front putting face 32. This bore 38 is disposed in the central upper portion of the ram 30.

The lower end 39 of the shaft 12 extends through the dome top 19 of the putter head and through a transverse bore 40 of the ram member 30 to be fixed therein by a press fit, or by deformation of a portion thereof traversing the longitudinal bore 38.

Figure 6:
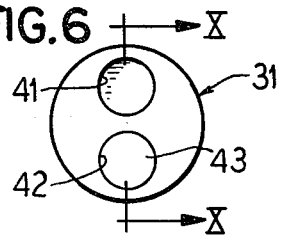
FIGS. 6 through 9 are front end elevational views of various forms of rotatable weight rod or ram members.
Figure 10:
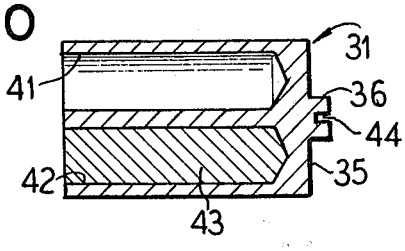
FIGS. 10 through 13 are respectively longitudinal cross-sectional views of the ram members of FIGS. 6 through 9.

As shown in FIGS. 6 and 10, the rotatable ram portion 31 has open front longitudinal bores 41 and 42 respectively in the top and bottom thereof on opposite sides of the longitudinal center line. These bores have blind ends closely adjacent the rear face 35 and the lower bottom bore 42 is filled with a very heavy material 43, such as lead. The rotatable ram portion 31 is thus eccentrically weighted with a heavy bottom section below the longitudinal axis thereof. The open bore 40 of the ram portion 30 communicates with the longitudinal bore 38 of the fixed ram portion 30 when the lead filled bore 42 is below the longitudinal center, although rotation of the ram 31 can move the bore 41 out of communication with the bore 38.

As shown in FIG. 10, the neck or nubbin 36 has a transverse slot 44 accessible through the opening 28 in the closed end 26 of the bore or chamber 25 of the housing 24. A coin or screw driver inserted in this slot 44 will rotate the ram portion 31 to position the heavy weighted lead filled bore 43 as desired. The rotatable ram portion 31 may take a number of different forms shown, for example, in FIGS. 7 through 13.

Figure 7:
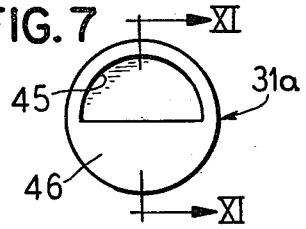
Figure 11:
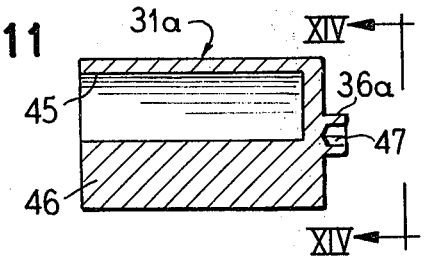
Figure 14:
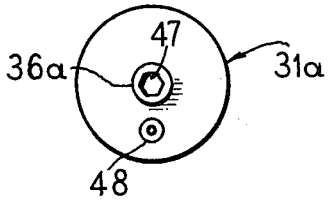
FIG. 14 is a rear end elevational view of the ram member of FIGS. 7 and 11, taken along the line XIV—XIV of FIG. 11.

In FIGS. 7 and 11, the rotatable ram 31*a* has a hollow top portion 45 with a solid bottom portion 46 thereby providing the desired eccentric weight distribution. The neck 36*a* on this modified ram member 31*a* has a hexagonal socket 47 for receiving a key to rotate the member. As shown in FIG. 14, an indicator button 48 is also provided in alignment with the axis of the heavier solid bottom portion 46 which, as shown, is in the six o'clock position as viewed from the back face 27 of the putter head.

Figure 8:
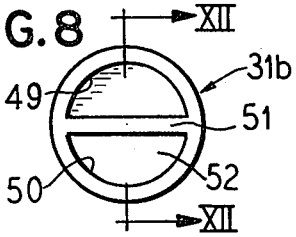
Figure 12:
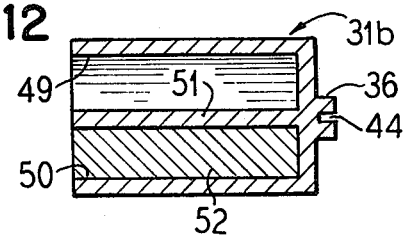
Figure 9:
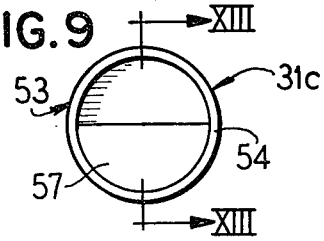
Figure 13:
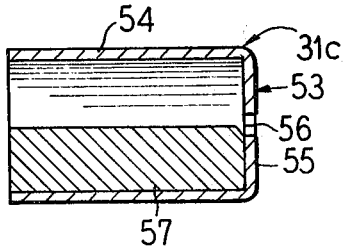

In the modification of FIGS. 8 and 12, the ram member 31*b* has hollow top and bottom portions 49 and 50 separated by a diametric wall 51. The bottom portion 50 is filled with heavy material 52, such as lead. The hollow portions 49 and 50 have open front ends and closed rear ends. In the additional embodiment of FIGS. 9 and 13, the ram member 31*c* is composed of a stamped metal generally in the shape of a cup 53 with a cylindrical side wall 54 and a flat bottom wall or back 55. A slot 56 in the central portion of this back wall 55 is adapted to be registered with the aperture in the rear face of the lead 24 to receive the screw driver for rotating the member. The cup-like member 53 has the bottom half thereof filled with a heavy material 57 such as lead.

Figure 2:
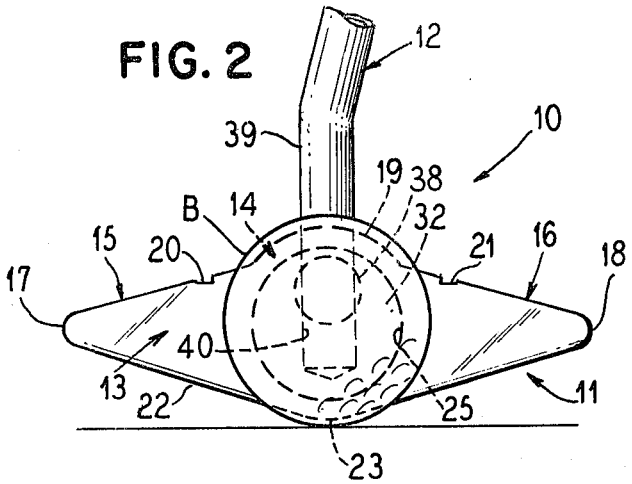
FIG. 2 is a front elevational view of the ball and putter of FIG. 1 with the upper portion of the shaft omitted.
Figure 3:
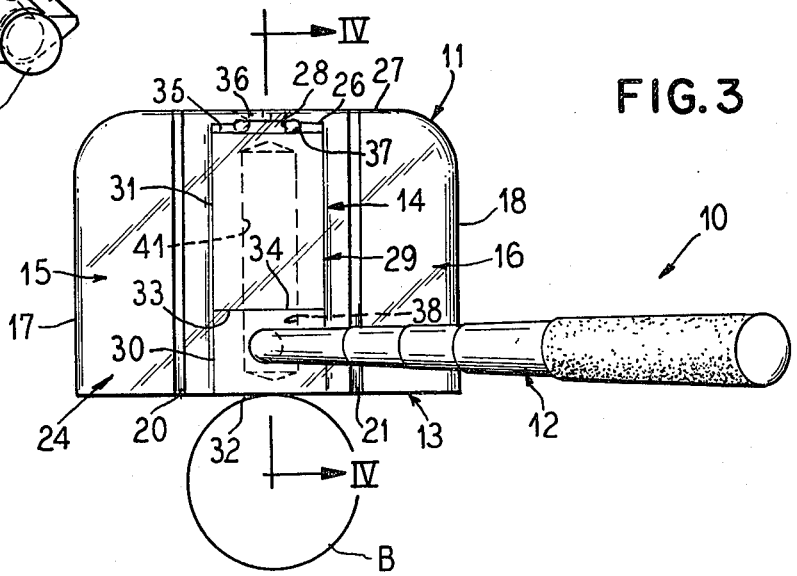
FIG. 3 is a top plan view of the putter and ball of FIG. 1.
Figure 4:
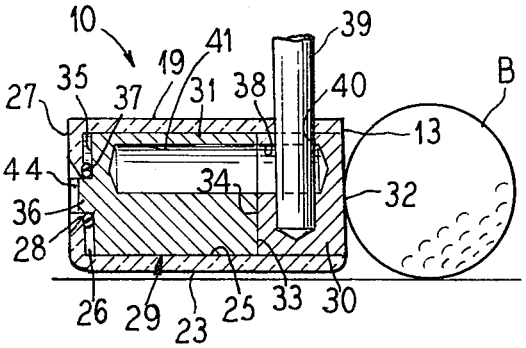
FIG. 4 is a longitudinal cross-sectional view, with parts in elevation, taken generally along the line IV—IV of FIG. 3.
Figure 5:
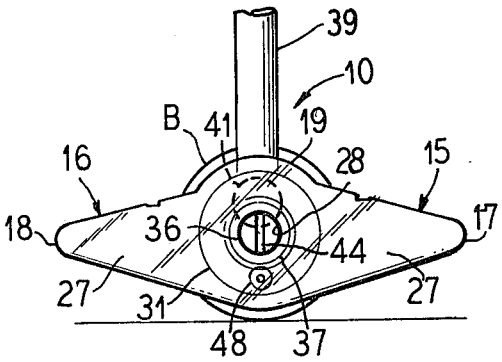
FIG. 5 is a rear end elevational view of the putter of FIGS. 1 to 4.

When the putter 10 is aligned with the ball B as shown in FIGS. 1 to 3, the axis of the fixed ram member 30 will be aligned so that the end face 32 will impact the ball at the longitudinal center of the ram. Then when the putter head is swung on this axis the ball will be impacted to roll on the aimed at putting line. However, due to manufacturing tolerances and variations in putting strokes of individual golfers, the club may not have the desired "feel" to instill confidence in the golfer. To compensate for these variations, the rotatable ram portion 31 is adjusted to position the eccentric weighted portion thereof as desired. At the very bottom or six o'clock position, this weight portion will offset any counteraction of the weighted portion of the shaft entering the head and will provide for a relatively "low" "sweet spot". Rotating the eccentric weighted portion of the ram 31 from the bottom-most six o'clock position either clockwise to a seven o'clock position or counterclockwise to a five o'clock position will change the front to rear axial center line of mass to provide a different "feel" to the golfer and correcting against, for example, pulled or pushed putts.

From the above description, it will therefore be understood that this invention provides a golf club putter which can be easily adjusted to suit individual golfers.

I claim as my invention:

1. In a golf putter having a shaft and a head secured on the end of the shaft with an upstanding front ball impacting face and front-to-rear elongated central axis of mass with a front end providing a sweet spot area on said face, the improvement of an eccentric weight rotatably mounted in said head on said axis to shift the mass for providing a personalized feel to the golfer facilitating impacting of the ball on a sweet spot in said area which will propel the ball on the desired putting line.

2. In the putter of claim 1, the further improvement of said head formed from transparent plastics material and said weight being visible with a projection at the rear end thereof accessible for effecting rotation of the weight.

3. A golf putter having a mallet head with an elongated front-to-rear heavy ram central zone providing a ball impacting face and a front-to-rear bore in said zone, a rotatable eccentric weight in said bore, and means accessible from outside said head to rotate said weight for adjusting the center of mass of the head.

4. The putter of claim 3 wherein the means accessible for rotating the weight is a projection on the weight accessible from the rear end of the head.

5. The putter of claim 3 wherein the bore has a blind rear end with an aperture aligned with the axis of the bore and the rotatable weight has a neck projecting into the aperture accessible for effecting rotation of the weight.

6. The putter of claim 3 including a resilient member interposed between the rotatable weight and the head to resist movement of the weight in the bore.

7. The putter of claim 6 wherein the resilient means is a seal ring.

8. A golf putter which comprises a shaft, a transparent plastics material mallet head secured on the end of the shaft having a front ball impacting face, a rear end substantially spaced from said front face, and a front-to-rear bore, a front weight rod secured in the front end of the bore having a front face providing a sweet spot area on said ball impacting face, a second weight rod rotatably mounted in said bore behind said front rod having a heavy portion displaced from the axis of the bore, and means accessible from said rear end of the mallet head for rotating said second weight rod to shift the center of mass of the head.

9. The putter of claim 8 wherein the rotatable rod rotates about the axis of the bore and is heavier on one side of the axis than on the opposite side.

10. The putter of claim 8 wherein the shaft extends through the head into said front rod.

11. The putter of claim 8 wherein the rotatable rod has indicia visible through the transparent head indicating the heavy side of the rod.

* * * * *